US006126524A

United States Patent [19]

Shepherd

[11] Patent Number: 6,126,524

[45] Date of Patent: Oct. 3, 2000

[54] APPARATUS FOR RAPID REPETITIVE MOTION OF AN ULTRA HIGH PRESSURE LIQUID STREAM

[76] Inventor: John D. Shepherd, 13822 Bruns Rd., Manhattan, Ill. 60442

[21] Appl. No.: 09/353,179

[22] Filed: Jul. 14, 1999

[51] Int. Cl.[7] ..... B24C 3/00

[52] U.S. Cl. ..... 451/75; 451/102; 83/177; 134/172

[58] Field of Search ..... 451/75, 102; 83/177; 134/172

[56] References Cited

U.S. PATENT DOCUMENTS

| | | | |
|---|---|---|---|
| 4,669,760 | 6/1987 | Hashish et al. . | |
| 4,854,091 | 8/1989 | Hashish et al. . | |
| 4,936,059 | 6/1990 | Hashish et al. . | |
| 4,937,985 | 7/1990 | Boers et al. | 451/75 |
| 5,155,946 | 10/1992 | Domann | 451/75 |
| 5,255,853 | 10/1993 | Munoz | 239/433 |
| 5,505,653 | 4/1996 | Nedo et al. | 451/5 |
| 5,605,492 | 2/1997 | Klingel | 451/40 |
| 5,643,058 | 7/1997 | Erichsen et al. | 451/99 |
| 5,759,086 | 6/1998 | Klingel | 451/28 |

OTHER PUBLICATIONS

"Hydrocut Water Jet Cutting Machine", the title pages and pp. 2–4, 2–5, 2–7, 2–8, 2–12, 4–29, 4–30 and 2–24 through 6–26 of ESAB Cutting Systems manual No. F14–135 dated May, 1999.

*Primary Examiner*—Stephen F. Gerrity
*Assistant Examiner*—Rhonda E. Sands
*Attorney, Agent, or Firm*—Mason, Kolehmainen, Rathburn & Wyss; Philip M. Kolehmainen

[57] ABSTRACT

A waterjet head is resiliently supported at one location along its axis and is pivotally supported at another, axially spaced location. The head is driven in a pivoting, oscillating manner by a drive system including a rotary motor and an eccentric. The outlet nozzle of the waterjet head pivots in an orbital path so that the UHP liquid or liquid/abrasive stream discharged from the nozzle describes an orbital path on an adjacent workpiece surface, enabling the stream to carry out a uniform surface treatment operation such as cleaning, polishing or milling without damaging the workpiece surface.

6 Claims, 2 Drawing Sheets

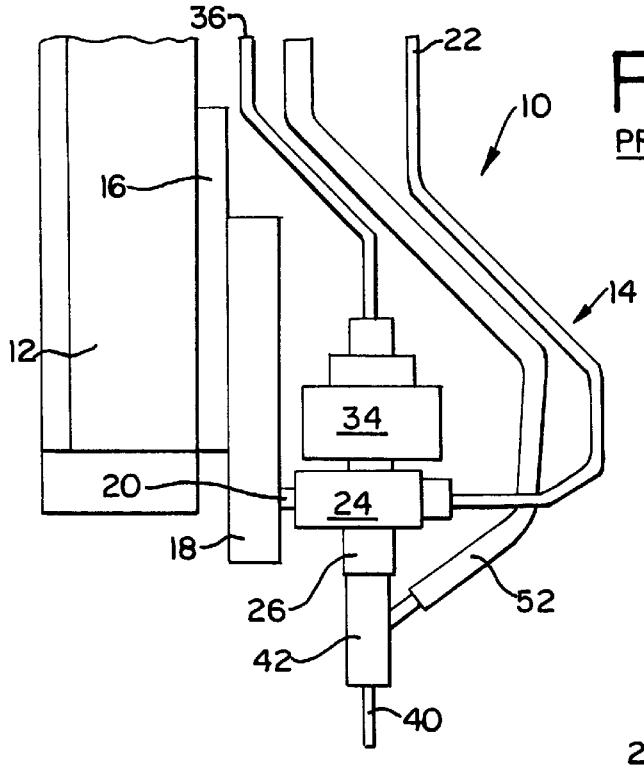
FIG. 1
PRIOR ART
FIG. 3
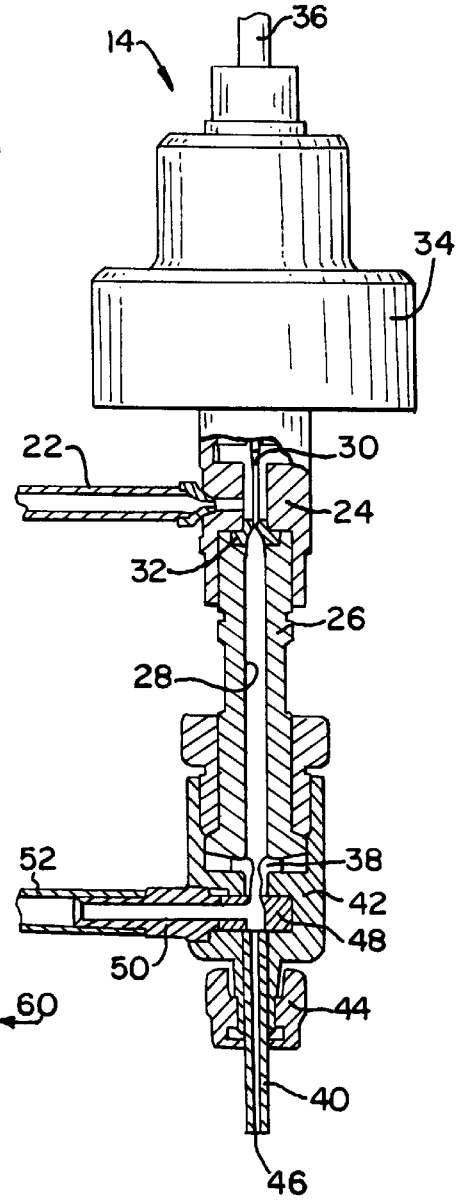
FIG. 2
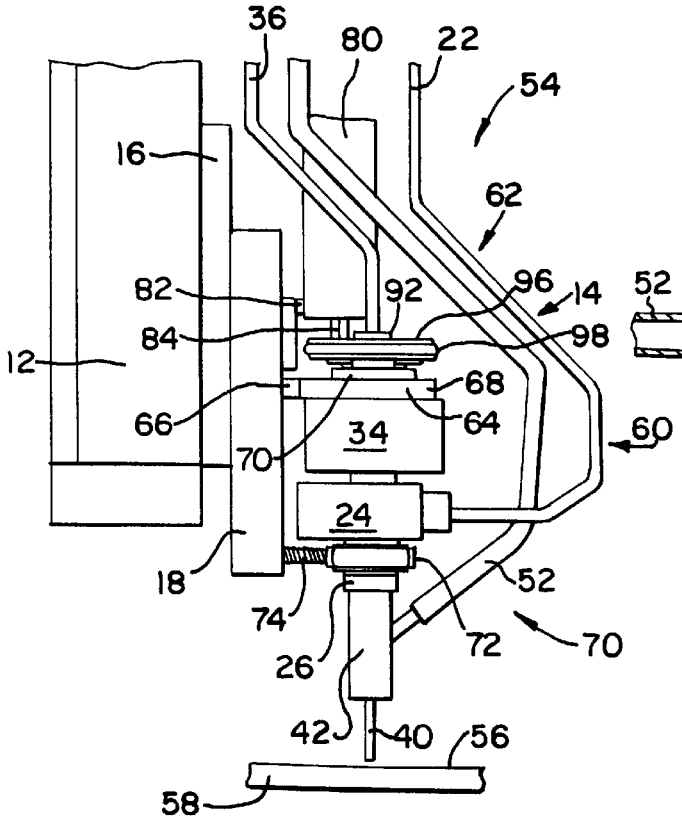

APPARATUS FOR RAPID REPETITIVE MOTION OF AN ULTRA HIGH PRESSURE LIQUID STREAM

FIELD OF THE INVENTION

The present invention relates to an apparatus and method for orbiting an ultra high pressure liquid stream, and more particularly to mounting and driving a waterjet head so that the stream discharged from the head can be used for surface treatment operations such as milling, polishing or cleaning of a workpiece surface.

DESCRIPTION OF THE PRIOR ART

Waterjet systems are used for cutting many types of materials. A waterjet system includes a waterjet head that is supplied with liquid at an ultra high pressure (UHP), for example 10,000 to 60,000 pounds per square inch psi). The UHP liquid is discharged from the head in a high velocity stream against a workpiece. The liquid stream is used to cut through materials such as wood, paper and foam. An abrasive particulate material can be added to the stream, and the liquid/abrasive stream can be used to cut through composites, metals and other dense materials. The stream typically is concentrated in a small area, for example, for example as small as 0.05 inch diameter and has a high flow rate of perhaps one to three gallons per minute (gpm). Because of their high energy concentrations, such waterjet streams cannot be used for surface treatment operations such as cleaning, polishing or milling. A typical waterjet liquid or liquid/abrasive stream cuts too deeply and rapidly into the workpiece surface if it is stationary for even a small fraction of a second, and uniform surface treatment has not been possible.

It has been recognized that a continuously and rapidly moving and accurately controlled waterjet stream could be used for surface treatment operations if the energy dissipation could be uniformly spread over the workpiece surface area. However, there has been a longstanding and unsolved problem with providing an apparatus or method for achieving this result.

Waterjet systems normally incorporate a head drive arrangement, such as a computer numerically controlled (CNC) X-Y-Z drive system intended to move the waterjet head in a programmable pattern for making preprogrammed accurate cuts in a workpiece. These known drive systems cannot move the head continuously and quickly enough in a controlled fashion to carry out a satisfactory surface treatment operation without damaging the workpiece surface.

In an attempt to solve this problem, it has been proposed to provide a waterjet head incorporating a discharge nozzle with an angled outlet passage and a swivel arrangement for rotating the nozzle. The intent of this approach is to provide a UHP stream that rotates at high speed to increase the workpiece surface area contacted by the stream and reduce the energy concentration of the stream. U.S. Pat. No. 4,669,760 discloses such a swivel fitting arrangement for a UHP liquid stream, and U.S. Pat. Nos. 4,854,091 and 4,936,059 disclose swivel assemblies for liquid/abrasive streams. The arrangements disclosed in these patents have not been successful, at least in part because of the difficulty of using relatively movable swivel joint components for carrying a highly abrasive stream of material. In addition, swivel arrangements suffer from other disadvantages including complexity and the lack of a convenient way to easily adjust system parameters.

SUMMARY OF THE INVENTION

A principal object of the present invention is to provide an improved apparatus and an improved method for orbiting an UHP stream; to provide an apparatus and method that can employ a conventional waterjet head and thereby avoid difficulties experienced with special swivel assemblies and the like; to provide an apparatus and method in which system parameters such as can easily and conveniently be controlled; to provide an apparatus and method that is inexpensive, reliable and simple; and to provide an apparatus and method that overcome problems with past approaches and solve the longstanding problem of using an UHP stream for workpiece surface treatment operations.

In brief, in accordance with the invention there is provided an apparatus for applying a high speed orbital motion to a high pressure and high velocity liquid stream for carrying out a milling, polishing, cleaning or like surface treatment operation upon a workpiece surface. The apparatus includes a waterjet head having a longitudinal axis, an ultra high pressure liquid inlet and an outlet nozzle for discharging a concentrated liquid stream. The head is supported to position the outlet nozzle relative to the workpiece surface. The supporting means includes first and second supports attached to the head at axially spaced first and second portions of the head. The first support includes a resilient member biasing the first portion of the head to a normal position and permitting limited movement of the first portion of the head around the normal position in a plane perpendicular to the longitudinal axis. The second support includes a socket defining a pivot point fixed relative to the normal position. A drive means connected to the head applies an orbital drive force to the head at a location remote from the pivot point for causing the head to pivot around the pivot point while the first portion of the head orbits around the normal position and the outlet nozzle orbits to move the liquid stream along an orbital path upon the workpiece surface.

In accordance with another aspect of the invention there is provided a method for applying a high speed orbital motion to a high pressure and high velocity liquid stream discharged onto a workpiece surface from the outlet nozzle of an axially elongated waterjet head for carrying out a surface treatment operation upon the workpiece surface. A first portion of the head is biased toward a normal position and is permitted limited movement around the normal position in a plane perpendicular to the longitudinal axis of the head. A second portion of the head is pivotally supported to define a pivot point fixed relative to the normal position. The head is driven with an orbital drive force to cause the head to pivot around the pivot point while the first portion of the head orbits around the normal position and the outlet nozzle orbits to move the liquid stream along a high speed orbital path upon the workpiece surface.

BRIEF DESCRIPTION OF THE DRAWING

The present invention together with the above and other objects and advantages may best be understood from the following detailed description of the preferred embodiment of the invention illustrated in the drawings, wherein:

FIG. 1 is a simplified, partly schematic side view of the waterjet head portion of a prior art waterjet system;

FIG. 2 is a simplified, partly schematic side view of an apparatus constructed in accordance with the present invention for orbiting an ultra high pressure liquid stream;

FIG. 3 is an enlarged side view, partly in section, of the waterjet head of FIG. 1 and FIG. 2;

DETAILED DESCRIPTION OF THE PREFERRED EMBODIMENTS

Figure 4:
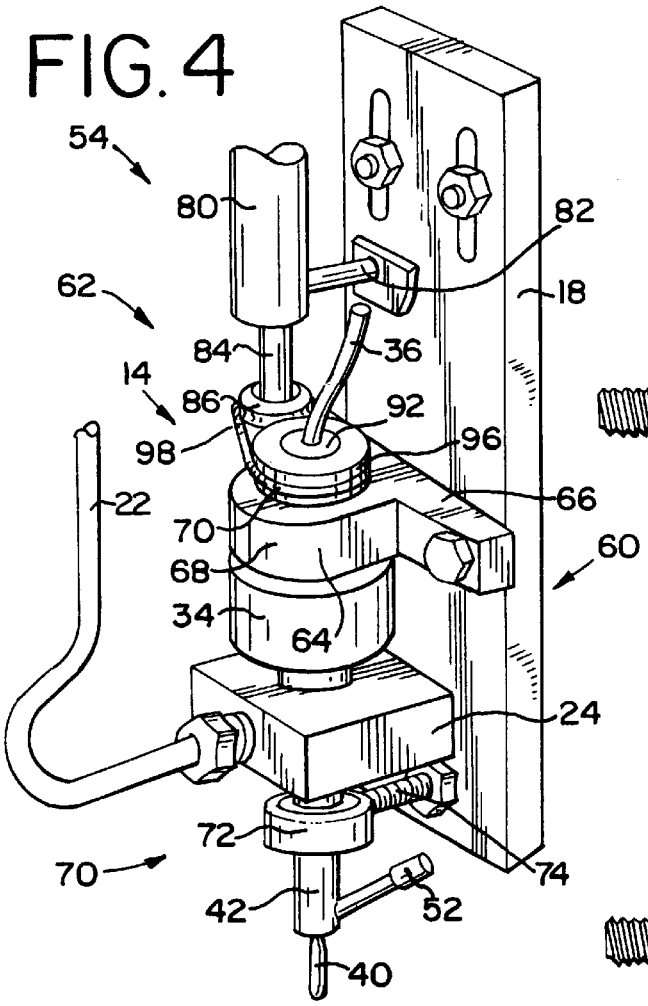
FIG. 4 is an isometric view of the apparatus of FIG. 2.

Having reference now to the drawings, portions of a prior art waterjet system 10 are illustrated in FIG. 1. A support member or lift 12 is operated, typically by a CNC system, to move a waterjet head 14 in three orthogonal X, Y and Z directions in order to position the waterjet head 14 relative to a workpiece upon which waterjet cutting operations are to be performed. A front plate 16 is carried by the lift 12, and a clamp plate 18 is supported by the front plate 16. The waterjet head 14 is attached to the clamp plate 18 by a suitable support 20.

Ultra high pressure (UHP) liquid is supplied to the waterjet head 14 from a suitable UHP pump system through a UHP liquid supply conduit 22 normally formed of stainless steel and having sufficient flexibility to permit movement of the waterjet head 14 around the surface of a workpiece. Liquid from the conduit 22 is received in an inlet member 24 best seen in FIG. 3. A body 26 defines an internal liquid chamber 28. A needle valve 30 cooperates with a seat 32 to either prevent or permit UHP liquid to flow from the inlet member 24 into the chamber 28. The needle valve 30 is operated by an air cylinder and return spring assembly contained within an air control housing 34 selectively supplied with pressurized air through a flexible rubber or neoprene air supply line 36.

When the needle valve 30 is opened by the application of pressurized air within the housing 34, UHP liquid flows through the chamber 28 and through an orifice 38 to a nozzle tube 40 mounted to a lower body 42 by a mounting nut 44. The nozzle 40 is aligned with the longitudinal axis of the waterjet head 14, and includes an axial discharge passage 46 through which a concentrated UHP liquid stream is discharged at high pressure and high velocity.

For many applications, fine particles of an abrasive material such as garnet is added to the liquid stream. A mixing chamber member 48 is received in the lower body 42 and receives particulate abrasive through an abrasive inlet fitting 50 and a flexible rubber or neoprene abrasive supply line 52. When UHP liquid flows through the mixing chamber member 48, abrasive material is entrained in the liquid stream and a liquid/abrasive stream having increased cutting capability is discharged from the nozzle passage 46.

Prior art waterjet systems of the type seen in FIG. 1 are commercially available from sources including EASB Cutting Systems, 411 Ebenezer Road, Florence, S.C. 29501-0504. A further description of the prior art system 10 can be found at the title pages and pages 2–4, 2–5, 2–7, 2–8, 2–12, 4–29, 4–30 and 2–24 through 6–26 of ESAB Cutting Systems manual No. F14–135 dated May, 1999, filed herewith and incorporated herein by reference.

Although prior art waterjet systems are satisfactory for cutting operations where cuts are formed through a workpiece, it would be desirable to use a waterjet system for workpiece surface treatment operations such as cleaning, polishing or milling. Surface treatment operations of this type require a relatively small, uniformly thick amount or layer of material to be removed from a workpiece surface without cutting deeply into or through the workpiece. The prior art waterjet system 10 is incapable of performing such operations using UHP liquid or liquid/abrasive streams because of the high concentration of the stream striking a small area of the workpiece surface.

The present invention provides an apparatus 54 and method for applying a orbiting UHP stream to the surface 56 of a workpiece 58 (FIG. 2). An important advantage of the apparatus 54 and method of the present invention is that it can employ the conventional prior art waterjet head 14, and special complex heads or modifications such as swivels are not required. The improved apparatus 54 of the present invention is seen in FIGS. 2 and 4, where the same reference characters are used for elements that are the same as those of the prior art system of FIG. 1.

In accordance with the invention, the apparatus 54 includes a waterjet head support system 60 supporting the waterjet hear 14 for pivoting and oscillatory movement and a drive system 62 for moving the waterjet head 14 in order to move the UHP stream discharged from the head in an orbital path. The orbital path diffuses the concentration of the stream impinging onto the workpiece surface 56 and allows the liquid or liquid/abrasive stream to be used for surface treatment operations such as cleaning, polishing or miling.

The support system 60 includes a flexible resilient mounting yoke 64 having a base portion 66 fastened to the clamp plate 18 and a collar portion 68 receiving a reduced diameter segment 70 of the air control housing 34. Yoke 64 is made of a resilient material such as rubber, and continuously biases the waterjet head 14 toward a normal, typically vertical, position aligned with the lift 12. The resilience of the yoke 64 permits the portion of the waterjet head 14 captured within the collar portion 68 to move in all directions away from the normal position in a plane substantially perpendicular to the longitudinal axis of the waterjet head 14.

Figure 6:
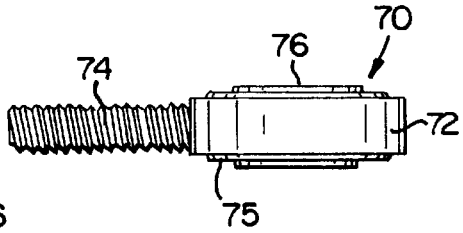
FIG. 6 is an enlarged side elevational view of the pivot mount assembly of the waterjet head support system of the apparatus of FIGS. 2 and 4.
Figure 7:
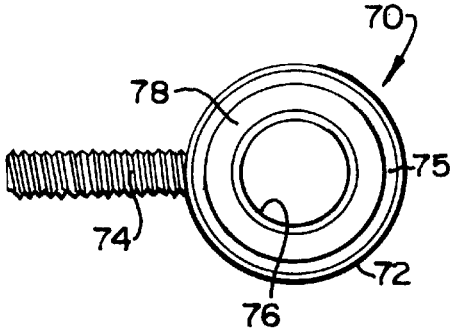
FIG. 7 is a top plan view of the pivot mount assembly of FIG. 6.

The support system 60 also includes a pivot mounting joint assembly 70, best seen in FIGS. 6 and 7, of the type known as a ball and socket or heim joint. A cylindrical outer mounting band 72 is attached to the clamp plate 18 by a threaded shank 74. The outer band 72 encircles an outer joint member 75 having an inner surface that is a concave spherical segment symmetrical around the spherical center. A cylindrical inner mounting band 76 is attached to a the body 26 of the waterjet head 14 at a position axially below the location of the yoke 64. The inner band 76 is encircled by an inner joint member 78 that has an outer surface that is a convex spherical segment symmetrical around the spherical center. The spherical convex surface of the inner joint member 78 rotatably nests in the concave spherical surface of the outer joint member 75. The joint assembly 70 defines a pivot point at the spherical center of the inner and outer joint members 74 and 78, and the waterjet heat 14 can pivot in all directions around this pivot point. In the apparatus 54, the pivot point is along the axis of the waterjet head 14, but other pivotal mounting systems could be used and the waterjet head could pivot about an offset pivot point.

Figure 5:
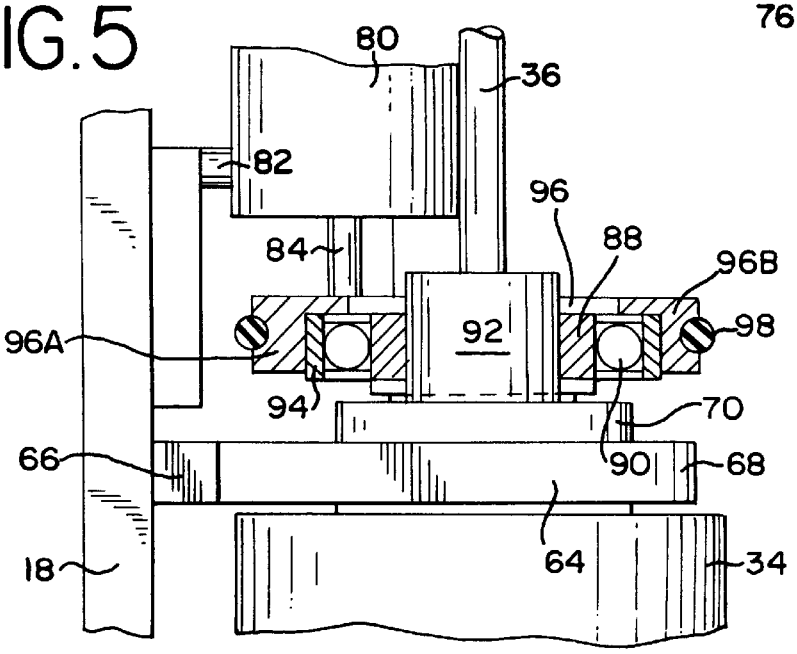
FIG. 5 is an enlarged view, partly in section, of the waterjet head drive system and of part of the waterjet head support system of the apparatus of FIGS. 2 and 4.

The drive system 62 includes a motor 80 held by a suitable support 82 to the clamp plate 18. Preferably the motor 80 is an air driven rotary motor. A motor drive shaft 84 carries a grooved sheave 86 (FIG. 4). The inner retainer 88 of a bearing assembly 90 (FIG. 5) is attached to an upper cap portion 92 of the air control housing 34, and the outer retainer 94 of the bearing assembly 90 carries an eccentric grooved pulley 96. A drive band 98 rotates the eccentric pulley 96 when the motor 80 is operated to impart an orbital motion to the cap portion 92 of the waterjet head 14. The pulley 96 includes a relatively thicker portion 96A and a relatively thinner portion 96B (FIG. 5). If desired, fixed idler wheel supports can be placed around the eccentric pulley 96 to assist the transfer of orbital drive force to the waterjet head 14. Because the pivot point imposed by the joint assembly 70 is along the head axis, the orbital path of movement of the head 14 is essentially circular. If an axially offset pivot point is used, the orbital path may be oval or non-circular.

Because the present invention can use a conventional waterjet head 14, problems with conveying UHP liquids and abrasives through complex assemblies with relatively movable parts are avoided. The standard UHP supply conduit 22 is sufficiently flexible and sturdy to withstand the relatively small motion of the waterjet head without damage. The point of connection of the conduit 22 to the inlet member 24 is axially close to the pivot point and moves only a slight amount. Thus the mounting point is not stressed and is not subject to failure.

In the illustrated embodiment, the pivot point established by the assembly 70 is approximately midway between the eccentric pulley 96 and the discharge end of the nozzle 40. Thus when the cap portion 92 is orbited by the drive system 62, the nozzle 40 is simultaneously and similarly orbited. As a result the UHP stream discharged from the nozzle 40 travels in an orbital pattern at an angle surrounding the normal axis of the waterjet head. The stream strikes the workpiece surface 56 in an orbital pattern, preventing highly concentrated contact and enabling surface treatment operations. The amount of eccentricity of the pulley 96 is selected to provide a desired orbital motion angle for the waterjet head. Depending on the UHP stream characteristics such as the presence or absence of abrasive, the stream size, velocity and pressure and upon the type of surface treatment operation to be performed, the angle may be selected as small as about one-half of one degree and up to as large as about five degrees.

The discharge end of the nozzle 40 may be spaced from the workpiece surface 56 by a distance as little as about 0.02 inch up to a distance as large as one inch or more. The area encompassed by the orbital UHP stream pattern increases as the distance between the nozzle 40 and the workpiece surface 56 increases. A relatively larger area may be preferable for cleaning operations, and a smaller area may be preferable for removal of a thicker surface layer in polishing and milling operations. The area can easily be adjusted by using the conventional X-Y-Z drive system to alter the distance of the nozzle 40 from the surface 56.

The speed of orbital stream movement can be varied by varying the rotational speed of the motor 80. For surface milling, the rotational speed can be 5,000 RPM or more; for liquid stream cleaning, the rotational speed can be 500 RPM or more and for cleaning and polishing with an liquid/abrasive stream the rotational speed can be 5,000 RPM or more.

The pressure of the stream may also be varied to achieve the desired performance. The presently attainable pressure range is approximately from about 10,000 to 60,000 psi, and it is believed that the invention could be practiced over a larger range of, for example, 5,000 to 100,000 psi. the diameter of the nozzle passage 46 can typically be selected within a range of from about 0.010 inch to 0.100 inch. The liquid flow rate of the UHP stream can typically be selected within a range of about 0.10 gpm to about 5 gpm.

While the present invention has been described with reference to the details of the embodiment of the invention shown in the drawing, these details are not intended to limit the scope of the invention as claimed in the appended claims.

What is claimed is:

1. Apparatus for applying a high speed repetitive motion to a high pressure and high velocity liquid stream for carrying out a surface treatment operation upon a workpiece surface, said apparatus comprising:

a waterjet head having a longitudinal axis, an ultra high pressure liquid inlet and an outlet nozzle for discharging a concentrated liquid stream;

means for supporting said head to position said outlet nozzle relative to the workpiece surface;

said supporting means including first and second supports attached to said head at axially spaced first and second portions of said head;

said first support including a resilient member biasing said first portion of said head to a normal position and permitting limited movement of said first portion of said head relative to said normal position in a plane perpendicular to said longitudinal axis;

said second support defining a pivot point fixed relative to said normal position; and drive means connected to said head for applying a drive force to said head at a location remote from said pivot point for causing said head to pivot at said pivot point while said first portion of said head repetitively moves relative to said normal position and said outlet nozzle repetitively moves to move the liquid stream along a path upon the workpiece surface.

2. Apparatus as claimed in claim 1, said outlet nozzle being directed along said longitudinal axis.

3. Apparatus as claimed in claim 1, said head including an abrasive particle inlet for introducing abrasive particles into the liquid stream.

4. Apparatus as claimed in claim 1, said pivot point being located along said longitudinal axis.

5. Apparatus as claimed in claim 1, said second portion of said head being between said outlet and said first portion of said head.

6. Apparatus as claimed in claim 1, said drive means including an eccentric member, a bearing supporting said eccentric member for rotation on said head and a drive motor for rotating said eccentric member.

* * * * *